US009693931B2

(12) United States Patent
Salo Darder et al.

(10) Patent No.: US 9,693,931 B2
(45) Date of Patent: Jul. 4, 2017

(54) SUPPORT DEVICE FOR A SKIN TREATMENT ASSEMBLY

(75) Inventors: Jordi Salo Darder, La Bisbal d'Empordá (ES); Antoni Godayol Martí, Taradell (ES)

(73) Assignee: MC HEALTH TECH, S.L., Barcelona (ES)

( * ) Notice: Subject to any disclaimer, the term of this patent is extended or adjusted under 35 U.S.C. 154(b) by 868 days.

(21) Appl. No.: 13/577,649

(22) PCT Filed: Feb. 16, 2011

(86) PCT No.: PCT/EP2011/052314

§ 371 (c)(1),
(2), (4) Date: Aug. 7, 2012

(87) PCT Pub. No.: WO2011/101388

PCT Pub. Date: Aug. 25, 2011

(65) Prior Publication Data

US 2012/0310119 A1 Dec. 6, 2012

(30) Foreign Application Priority Data

Feb. 22, 2010 (EP) ..... 10154302

(51) Int. Cl.

*A61H 7/00* (2006.01)
*A61H 9/00* (2006.01)
*A61H 37/00* (2006.01)

(52) U.S. Cl.

CPC ..... *A61H 37/00* (2013.01); *A61H 9/005* (2013.01); *A61H 9/0007* (2013.01); *A61H 9/00* (2013.01);

(Continued)

(58) Field of Classification Search

CPC ..... A61H 9/00; A61H 9/005; A61H 9/0057; A61H 2009/0064; A61H 2201/0119;

(Continued)

(56) References Cited

U.S. PATENT DOCUMENTS 978,760 A * 12/1910 Langworthy ..... 606/239
1,885,562 A 11/1932 Stephani (Continued)

FOREIGN PATENT DOCUMENTS

CN 2157772 Y 3/1994
CN 2714036 Y 4/2004

(Continued)

OTHER PUBLICATIONS

International Search Report (ISR), International Application No. PCT/EP2011/052314, International Filing Date Feb. 16, 2011, Date of Mailing ISR Mar. 10, 2011, 9 pages, Rijswijk Netherlands.

(Continued)

*Primary Examiner* — Justine Yu
*Assistant Examiner* — Tu Vo
(74) *Attorney, Agent, or Firm* — Peter B. Scull; Hamilton, DeSanctis & Cha LLP

(57) ABSTRACT

It comprises a connecting member and an arm structure having at least one hose connector associated with at least one skin treatment machine applicator. Device is suitable for maintaining the applicators at a given position when in use. A skin treatment assembly is further provided comprising a suction machine for applying pressurized air to a patient through applicators connected to corresponding hoses and the support device.

16 Claims, 3 Drawing Sheets

(52) U.S. Cl.
CPC ..... *A61H 2201/0119* (2013.01); *A61H 2201/1409* (2013.01); *A61H 2201/1669* (2013.01)

(58) Field of Classification Search
CPC ..... A61H 7/00; A61H 7/008; A61H 9/0007; A61M 1/00–1/127
See application file for complete search history.

(56) References Cited

U.S. PATENT DOCUMENTS 2,098,272 A * 11/1937 Benson ..... 601/6
2,143,320 A * 1/1939 Jones ..... 601/112
2,347,334 A * 4/1944 Schmieg ..... B24B 55/06 126/299 R
2,440,745 A 5/1948 Hauck
2,495,995 A 1/1950 Warrens et al.
3,120,373 A 2/1964 Medicus
3,266,505 A 8/1966 Kron
3,302,636 A 2/1967 Clemetson
3,315,665 A 4/1967 MacLeod
3,382,867 A * 5/1968 Reaves ..... A61H 9/005 601/14
3,457,913 A * 7/1969 Schopfel ..... 601/136
3,537,447 A * 11/1970 Gauthier ..... A61G 13/108 128/847
3,782,387 A * 1/1974 Falabella ..... A61B 17/322 128/898
3,794,035 A 2/1974 Brenner
3,841,323 A 10/1974 Stoughton
4,041,938 A * 8/1977 Wintoniw ..... 601/101
4,163,650 A * 8/1979 Watson ..... B03C 3/36 15/339
4,292,971 A * 10/1981 Smit ..... A61F 7/02 604/23
4,428,368 A * 1/1984 Torii ..... A61H 9/005 601/15
4,446,861 A * 5/1984 Tada ..... A61C 19/00 128/863
4,512,245 A * 4/1985 Goldman ..... B01D 46/10 454/63
4,548,373 A * 10/1985 Komura ..... 248/122.1
4,748,973 A 6/1988 Cho
4,875,470 A * 10/1989 Cotone ..... 601/117
4,984,568 A * 1/1991 Persaud ..... 601/122
5,016,617 A * 5/1991 Tarlow et al. ..... 601/117
5,094,260 A 3/1992 Stuart et al.
5,427,569 A * 6/1995 Plymoth ..... B08B 15/002 454/63
5,451,086 A 9/1995 Pazzaglia
5,597,385 A * 1/1997 Moerke ..... A61B 18/00 55/357
5,662,677 A 9/1997 Wimmer
5,665,053 A 9/1997 Jacobs
5,727,569 A 3/1998 Benetti et al.
5,746,404 A * 5/1998 Merko ..... 248/123.11
5,769,702 A * 6/1998 Hanson ..... A61B 18/00 128/204.18
5,897,512 A 4/1999 Zagame
5,902,293 A 5/1999 Liu
5,906,607 A 5/1999 Taylor et al.
6,030,318 A 2/2000 Howard
6,032,672 A 3/2000 Taylor
6,143,048 A * 11/2000 Comproni ..... B01D 46/0036 118/326
6,164,570 A * 12/2000 Smeltzer ..... F16L 11/18 138/120
6,277,052 B1 8/2001 Howard
6,283,929 B1 * 9/2001 Mjehovic ..... 601/136
6,309,364 B1 10/2001 Cathaud et al.
6,397,885 B1 6/2002 Golden et al.
6,439,773 B1 8/2002 Fujikawa et al.
6,484,747 B2 * 11/2002 Bridgers ..... 137/355.17
6,508,268 B1 1/2003 Kouketsu
6,527,783 B1 3/2003 Ignon
6,539,946 B2 4/2003 Weyergans
6,820,638 B1 * 11/2004 Gosinski ..... F16L 41/03 137/343
6,936,017 B2 8/2005 Zhu
7,384,379 B2 6/2008 Egger
8,460,417 B2 * 6/2013 Reid ..... B08B 15/04 55/356
2002/0007836 A1 1/2002 Weyergans
2002/0193727 A1 12/2002 Zhu
2003/0234137 A1 12/2003 Buckner
2004/0073144 A1 4/2004 Carava
2004/0106907 A1 6/2004 Liu
2004/0193077 A1 * 9/2004 Hsu ..... A61H 9/0071 601/49
2004/0236252 A1 11/2004 Muzzi et al.
2005/0027218 A1 2/2005 Filtvedt et al.
2005/0070405 A1 3/2005 Egger
2006/0206040 A1 9/2006 Greenberg
2006/0211958 A1 9/2006 Rosenberg et al.
2007/0027411 A1 2/2007 Ella et al.
2007/0208281 A1 9/2007 Brooks
2008/0009815 A1 1/2008 Grabenkort et al.
2008/0091126 A1 4/2008 Greenburg
2008/0116346 A1 5/2008 McCarthy
2008/0200778 A1 8/2008 Taskinen et al.
2008/0234609 A1 9/2008 Kreindel et al.
2009/0036959 A1 2/2009 Filtvedt et al.

FOREIGN PATENT DOCUMENTS

CN 1756522 A 4/2006
DE 10149418 A1 1/2003
DE 10149418 A1 4/2003
DE 60307681 T2 8/2007
EP 1064907 A1 6/2000
EP 1736131 A2 12/2006
EP 1736132 A2 12/2006
ES 2271671 T3 12/2005
FR 2850862 A1 11/2003
GB 190907959 A 11/1909
GB 319489 A 9/1929
GB 608866 A 9/1948
GB 624851 A 6/1949
GB 2299759 A 10/1996
GB 2397236 A 7/2004
JP S52112193 U 8/1977
JP H0420335 U 2/1992
JP 2008532591 A 8/2008
JP 2008252286 A 4/2010
JP 20110169467 A 2/2013
RU 2026052 C1 9/1995
RU 2181275 C1 4/2002
RU 2181275 CI 4/2002
RU 2259185 C2 8/2005
SI 9700234 A 4/1999
WO 92/08179 A1 5/1992
WO 94/24980 A1 11/1994
WO 03/005921 A1 1/2003
WO 03/099188 A1 12/2003
WO 2004/058131 A2 7/2004
WO 2004/066899 A2 8/2004
WO 2006/094348 A1 9/2006
WO 2007/051896 A1 5/2007
WO 2007/068060 A1 6/2007
WO 2007/103914 A2 9/2007
WO 2007/112902 A1 10/2007
WO 2008060949 A 5/2008
WO 2009007597 A1 1/2009
WO 2010/013259 A1 2/2010

OTHER PUBLICATIONS

Written Opinion (WO), International Application No. PCT/EP2011/052314, International Filing Date Feb. 16, 2011, Date of Mailing WO Mar. 10, 2011, 4 pages, Rijswijk Netherlands.

(56) References Cited

OTHER PUBLICATIONS

English Translation of Notice of Reasons for Rejection issued by the Japanese Patent Office in counterpart foreign application No. 2012-553308, date issued: Dec. 2, 2014.

* cited by examiner

SUPPORT DEVICE FOR A SKIN TREATMENT ASSEMBLY

CROSS REFERENCES TO RELATED APPLICATIONS

This application is a national stage filing under 35 USC 371 of international application No. PCT/EP2011/052314, dated 16 Feb. 2011 and published on 25 Aug. 2011 under international publication No. WO 2011/101388, which claims priority to EP 10154302.3 dated 22 Feb. 2010. Both are hereby incorporated by reference as though fully set forth herein.

TECHNICAL FIELD

The present disclosure belongs to the field of skin treatment and more specifically to devices which make use of vacuum generation for skin treatment. Vacuum is applied to the patient's skin in order to treat pain, discomfort and various pathologies related to the skin and muscle.

A support device is provided to be used in a skin treatment assembly with such an assembly comprising a suction machine configured to be used for skin treatment. The present support device comprises a connecting member and an arm structure associated therewith that is capable of holding in place a number of applicators in contact with the patient's skin during treatment.

BACKGROUND

Skin treatment machines are known suitable for skin treatment, massage, etc. which employ suction, that is, the application of negative pressure to a patient's skin. A suction device is typically provided in known treatment machines which are configured to produce a vacuum. Positive pressure may be also applied if required. One or even several applicators are typically used in the form of, for example, cup members for applying pressure, whether it is a positive pressure, negative pressure, or a pattern of combined pressure values. Applicators serve the purpose of effectively applying pressure to a location in the patient's skin through corresponding hoses. Hoses are connected to the suction device of the skin treatment machine. Known machines further comprise a valve and a controller for applying pressure to the patient's skin in a controlled way for an efficient body treatment.

In prior art treatment machines, once an operator, that is a physiotherapist, a massage therapist, etc., has selected an appropriate mode of operation (that is defined by a series of treatment parameters such as a suitable level of suction, preset vacuum pattern—steady, pulsating, oscillating—, length and pressure values, etc) vacuum is applied through each applicator to the patient's skin according to the specific skin treatment that has been selected by an operator. The operator then holds the applicator or the applicators on the target skin location such that it/they is/are always in contact with the patient's skin during treatment.

One example of a treatment device is disclosed in WO2006094348. This document teaches a device for body contouring and skin conditioning. It comprises an applicator to be placed against the skin by an operator. An oscillating pressure is applied to a patient causing vibration of the skin surface.

U.S. Pat. No. 3,794,035 shows a vacuum unit comprising separate shut-off valves that are connected to a chamber in each of which a fixed pressure is pre-set at amounts differing one from another. Hoses are provided having a first end connected to each of the respective valves and a second opposite end configured to receive a suction applicator. Suction applicators have to be held by an operator always in contact with the patient's skin during treatment.

In these prior art known suction skin treatment devices, there is a need for an operator or technician who is always pressing the applicator on the target location of the patient's skin in a way that treatment is carried out properly. The operator must first select an appropriate mode of operation, then select the target location of the patient's skin where the applicator is to be applied and finally keep the applicator in contact with the skin during treatment.

The need for an operator who is always exerting pressure on a target location of the patient's skin through one applicator (or two if using both hands) during the skin treatment makes it to be expensive as several operators must be present if a multiplicity of applicators are needed in a skin treatment for the same patient. Even if a single operator has only to be present in a skin treatment, he/she can not attend or monitor other patients or performing other operations.

In addition, it has been found that the use of manual applicators may become painful to the professional operator or operators who must apply high levels of pressure on the patient's skin surface through each applicator by using their own hands when performing treatment. Local skin treatment in which operator must stay long time at the same patient's body portion to be treated often leads to damage or at least tiredness to the operator.

This often results in overloads on the operator's joints of the hand and even in chronic illnesses, such as osteoarthritis, arthritis, rhizarthrosis. Deep massage techniques are therefore rarely performed by physiotherapists or massage therapists due to such a significant effort to be performed with their fingers. As a consequence, a skin treatment can not be optimally performed.

The present disclosure provides a solution for the above drawbacks in a way that pressure skin treatments can be effectively performed in a way that the operator is no longer tired out and/or damaged during treatment and with which several patients can be automatically treated and/or monitored through the same operator.

SUMMARY

A support device for a skin treatment assembly is provided as well as a skin treatment assembly that comprises said support device which overcome the aforementioned problems through an useful alternative in body skin suction treatments that provides additional advantages as it will be described hereinafter.

A support device for a skin treatment assembly comprises an arm structure that is associated with a connecting member. This connecting member may be coupled, for example, to a support member such as an upright elongated member, e.g. an upright post mounted on a lower base portion. The connecting member may be displaceably coupled to the support member such that the arm structure attached thereto is adjustable in height depending on where the patient is (e.g. on a stretcher, in a wheelchair, standing up, etc) during treatment. In other embodiments, the connecting member may be fixedly coupled to the support member. In still other embodiments, the connecting member may be also coupled directly to a wall or ceiling if required. If mounted on a wall, for example, the connecting member may be displaceably fitted into a guide such that the connecting member may slide therealong for adjusting to a required height depending on where the patient is during treatment.

In the embodiment in which the connecting member is coupled to a support member, whether it is displaceably or fixedly coupled thereto, a lower base portion can be provided having a set of wheels, such as for example dual wheel carpet casters, so that it can be easily moved in the proximity of a patient's body for a proper positioning of the support device. Other base arrangements (e.g. with rollers, or even with no casters) are of course envisaged according to treatment requirements.

In one implementation, the present support device further comprises at least one hose connector that is associated with the arm structure and with at least one skin treatment machine applicator. More particularly, the hose connector may be a connector block made, for example, of a suitable vibration damping material for absorbing any vibrations caused by a suction machine. The connector block is provided with an inner cavity that is conveniently shaped and sized for receiving a complementarily shaped portion of the carrying structure. For example, the connector block in each hose connector may be provided with a quadrangular shaped cavity, that may be a through cavity, for receiving a carrying structure having a complementary quadrangular shaped cross section. With this configuration, hose connectors can be easily and efficiently coupled in and decoupled from the carrying structure. This further allows the hose connectors to be rapidly exchanged for adapting to different requirements or in replacement and/or maintenance operations.

Hose connectors are suitably designed for receiving one or several hoses for conducting pressurized air from a suction device in a suction machine. There may be provided one or a series of hose connectors each carrying and holding one or several hoses. Said one or a series of hose connectors are fitted in the present support device as disclosed above (i.e. by being fitted in the cavity of the carrying structure) and remains fixed there during treatment. Hose connectors are such that any working movements are reduced and they are not transmitted to the applicators thus ensuring an efficient treatment.

Regarding the arm structure of the support device, it may comprise two substantially parallel arms. A first end of each arm is pivotally mounted on the connecting member. The connecting member can be releasably clamped, for example, to a support member. A second, opposed end of each arm is configured to pivotally receive a respective end of a carrying structure configured to receive the hose connector or connectors. The arm structure of the support device is pivotable around respective horizontal axes at said first and second ends of the parallel arms. The weight of the arm structure is selected such that the parallel arms and the carrying structure do not move when in use.

With the above configuration, the connecting member can be displaced upwards or downwards along the support member and the parallel arms may be pivoted for raising or lowering the carrying structure as desired by the operator, and therefore the hose connector or connectors. This allows to place the applicator or applicators at a suitable height once the target positioning have been reached, that is, with said applicator or applicators in contact with the patient's skin ready to start the skin treatment.

Once applicator(s) have been positioned and the appropriate mode of treatment has been selected by the operator, there is no need for the operator to be present so that he/she can perform other treatments, other operations or monitoring other patients.

In some embodiments of the present support device, it may comprise a fastener for fixing the position of the arm structure relative to the connecting member. Such fastener allows the arm structure to be fixed such that the carrying structure holds the hose connector or connectors at a constant height throughout the skin treatment or at least until the operator desires the vertical position of the hose connectors to be varied. Further fasteners may also be provided for fixing the position of the connecting member, e.g. to a support member, to wall or ceiling, etc.

Still in some embodiments the present support device may comprise one or more motor which may cause the arm structure to be driven upwards or downwards and/or for driving the pivotal movement of the arm structure. The support device may include a controller for controlling several treatment parameters (such as length, pressure, applicator position, etc). Said controller may include an output device such as a display screen and an input device such as a keyboard.

With the above arrangement it is no longer necessary for the operator to hold the applicator or applicators throughout the skin treatment. The operator is allowed to attend other patients or doing other tasks in the meantime. This makes it possible to perform treatments, such as for example, release of contracture, tendonitis, postoperative fibrosis, muscle stretching, in an automatic process and effectively performed without the need for professional operators and by using a multiplicity of applicators as required for an efficient treatment. Such treatments can be performed on several patients simultaneously thanks to the present support device.

Therefore, a further advantage of the present support device is that it allows to save time and to provide cost effective treatments. Multiple automatic skin treatments can be performed concurrently without the presence of a professional operator for each treatment or patient. Once the applicator(s) has/have been positioned in the target position on the patient's skin and an appropriate mode of treatment has been appropriately selected and enabled in the suction machine of the assembly, the operator is not necessary to be present and she/he is free to do other tasks.

A skin treatment assembly is also provided. It comprises a suction machine having suction device for applying pressurized air to a patient (e.g. according to several pressurized airflow patterns) through at least one applicator connected to corresponding hoses. The skin treatment assembly according to the present support device is further provided with a support device as described above. The different parts of the support device, that is, the base portion, the connecting member, the support member (if present) and the arm structure, are sized such that vibrations from the suction machine when in use are reduced such that applicators substantially do not move.

By the provision of a suction system comprising a suction machine and a support device, skin surface and deep treatments are now possible without requiring high efforts on the part of the professional operator. Thanks to the provision of the connecting member, the present support device can be mounted on a desired or appropriate place, for example, through the use of a support device, or it can be wall or ceiling mounted, etc.

Treating patients by sanitary and cosmetic professional personnel is now possible at any position on a stretcher, in a wheelchair or even standing up and in general in situations where he/she has to be treated by a suction machine. For example, elderly and disabled people in wheelchairs does not need to be laid on a stretcher to be treated through the present suction system.

BRIEF DESCRIPTION OF THE DRAWINGS

A particular embodiment of the present support device for a skin treatment assembly as well as the skin treatment assembly comprising such a support device will be described in the following, only by way of non-limiting example, with reference to the appended drawings, in which.

DETAILED DESCRIPTION OF PARTICULAR EMBODIMENTS

One example of the present support device for a skin treatment assembly is shown in FIGS. 1-7. Skin treatments that can be conducted by the present assembly may be, for example, anticellulitis, drainage, lymphatic, aesthetic, fibrous, osteopathic, physiotherapeutic treatments as well as other pathologies. Skin treatment is herein understood as comprising body skin treatment, as well as facial, cervical treatments, etc.

Figure 1:
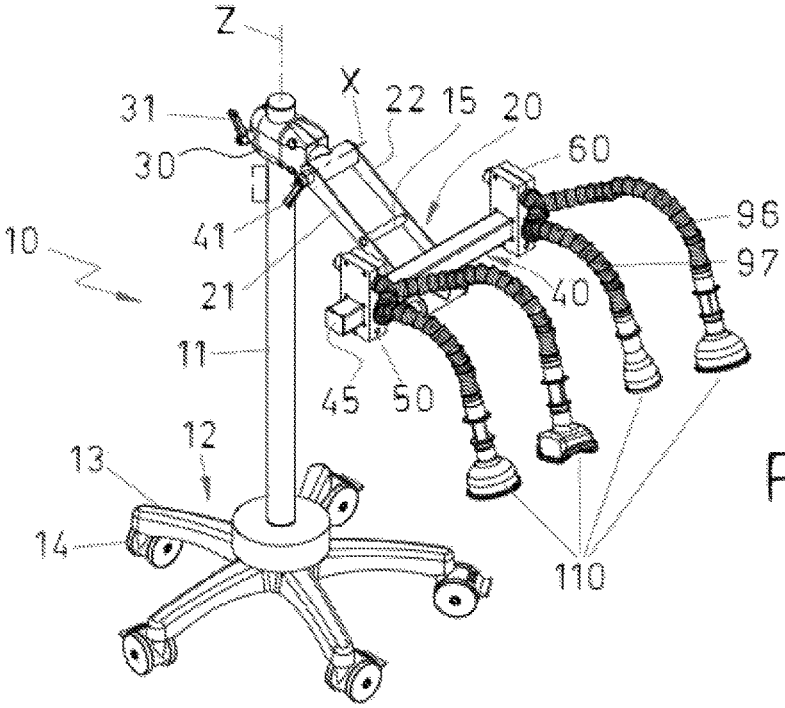
FIG. 1 is a general perspective view of one embodiment of the present support device, with the support device mounted on a support member and having several hose connectors having corresponding applicators and hoses.
Figure 2:
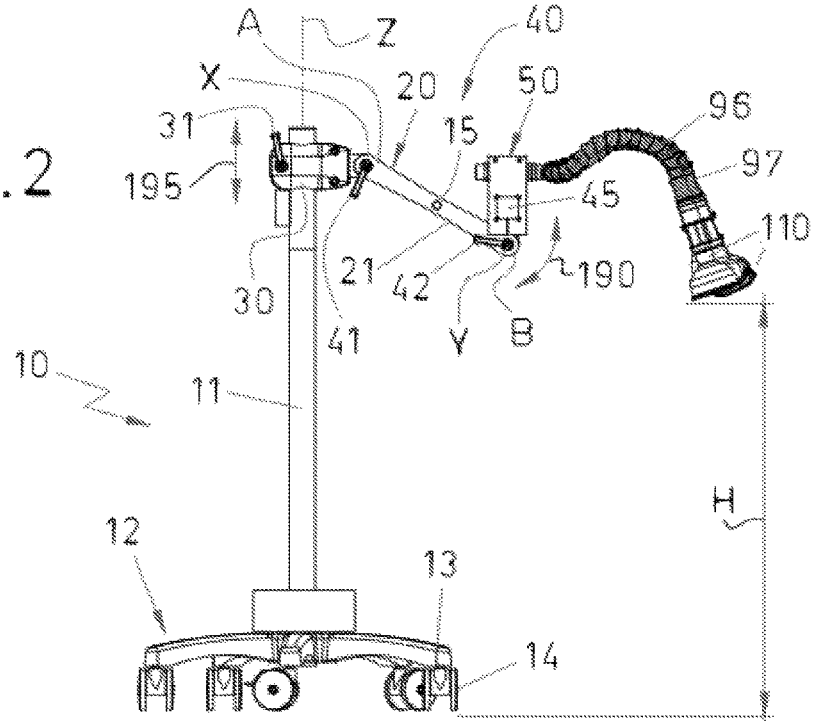
FIG. 2 is an elevational view of the embodiment of the support device of FIG. 1.
Figure 3:
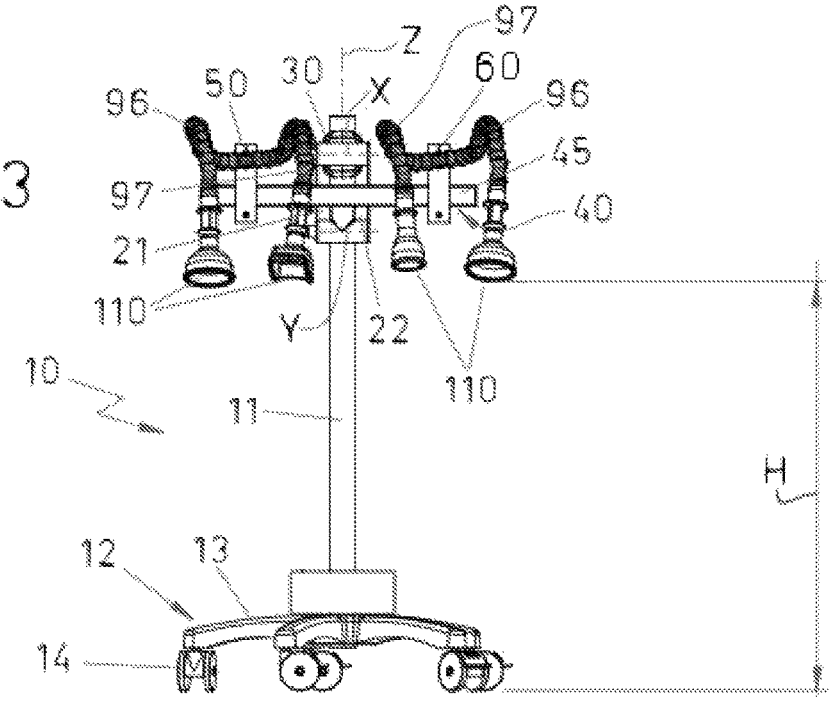
FIG. 3 is a front view of the embodiment of the support device of FIG. 1.

The embodiment of the present support device has been indicated at 10 in all Figs. and it has been shown in detail in FIGS. 1-3. As it can be seen, the support device 10 comprises a connecting member 30 that is displaceably mounted on a support member 11. In the example shown, the support member 11 is a substantially cylindrical vertical post fitted on a lower base portion 12. Base portion 12 is formed of a series of supporting arms 13 each carrying a dual wheel carpet caster 14. The wheeled base portion 12 allows the support device 10 to be easily moved in the proximity of a patient's body for a suitable positioning for a skin treatment. A suitable position of the support device 10 can be adjusted for patients laying on a stretcher, sitting in wheelchair or even standing up.

Other embodiments of support member 11 and lower base portion 12 may be of course possible. For example, the support member 11 may exhibit any suitable cross section other than circular and the lower base portion 12 may be, for example, a platform that may be fitted with casters 14 or with any other suitable devices for moving the support device 10 or even with no moving device whether a fixed support device is desired.

As an alternative, the connecting member 30 may be fixedly mounted on the support member 11. Still in other possible embodiments, the connecting member 30 may be wall or ceiling mounted (no support member 11 provided in such cases). In a wall mounted embodiment, the connecting member 30 can be adjusted in height by displacing it through a guide fitted on the wall.

In the particular embodiment of the support device shown in the figures, that is, the one in which the connecting member 30 is displaceably mounted on a support member 11, the support device 10 further comprises an arm structure that has been indicated as a whole at 20. The arm structure 20 of the support device 10 is pivotally coupled to the connecting member 30 through a substantially horizontal first axis X. Rotation of the arm structure 20 to the connecting member 30 and displacement (upwards/downwards) of the connecting member 30 along the support member 11 allows the relative vertical position H of the arm structure 20 to be accurately adjusted. Said relative vertical position H is defined as the height of applicators 110 (which will be fully described further on) to the ground, as shown in FIGS. 1 and 2. Height H can be therefore accurately adjusted as desired depending on where the patient is during treatment (patient is not shown in the drawings). Typical height H values may range up to 100 cm for a usual application with a patient lying on a stretcher. Other height H values are of course applicable for other positions of the patient during treatment.

The arm structure 20 of the support device 10 comprises two substantially parallel arms 21, 22 spaced apart to each other through a transverse reinforcing spacer 15. Each arm 21, 22 has first ends A and second, opposed ends B as shown in FIG. 2. The first ends A of the parallel arms 21, 22 are pivotally mounted on the connecting member 30, such that arms 21, 22 can be rotated around said substantially horizontal first axis X as shown in FIG. 2 through arrows. As stated above, the connecting member 30 may further slid along the support member 11 upwards and downwards as desired (see arrows in FIG. 2) in order to vary the height H of the applicators 110 to the ground according to where the patient is.

The connecting member 30 includes a fastener for fixing the position of the arm structure 20 relative to the support member 11. In this implementation, said fastener comprises a first screw and lever mechanism 31 suitable for fixing the connecting member 30 in position to the support member 11 once the desired height H to the ground has been reached. On the other hand, the second ends B of the parallel arms 21, 22 are further pivotally mounted on a carrying structure 40. Relative rotation of parallel arms 21, 22 and carrying structure 40 can be performed around a substantially horizontal second axis Y as shown in FIG. 2 through arrows. The arm structure 20 can be of course positioned by being rotated around a substantially vertical third axis Z that corresponds to the geometrical longitudinal axis of the support member 11.

The fastener further comprises a second and third screw and lever mechanisms 41, 42 which both serve the purpose of fixing the relative angular position of the parallel arms 21, 22 respectively. Therefore, relative angular position of the parallel arms 21, 22 around first and second horizontal axes X, Y, adjustment of height of the arm structure 20, rotation of the arm structure 20 around third vertical axis Z and the free movement of the base portion 12 allows the support device 10 to be properly positioned and accurately placed for an effective treatment. This allows to treat any patient in an automatic way whether she/he is on a stretcher, in a wheelchair, standing up, etc.

The carrying structure 40 of the arm structure 20 further comprises a carrying bar 45 that is arranged transverse to the parallel arms 21, 22. The carrying bar 45 of the arm structure 20 has, in the embodiment shown, a square cross-sectional configuration that is configured to receive a corresponding hose connector 50, 60. Other shapes in cross-section of the carrying bar 45 are of course possible as long as they are suitable for receiving a corresponding hose connector 50, 60. More particularly, the support device 10 is shown in the figures as comprising two of such hose connectors 50, 60. It will be understood that the support device 10 could comprise a different number of hose connectors 50, 60 depending upon the requirements of the treatment.

Figure 4:
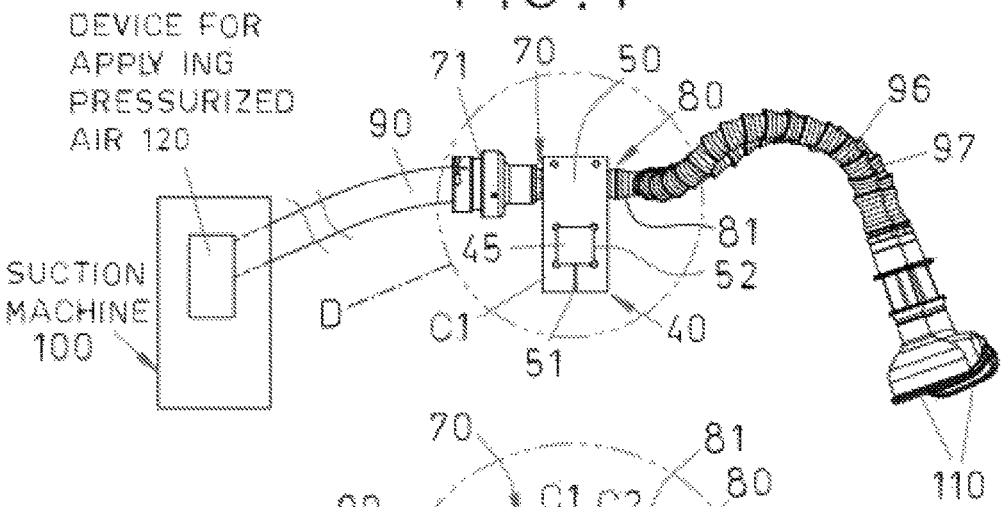
FIG. 4 is an enlarged view of one embodiment of a hose connector of the present support device.
Figure 5:
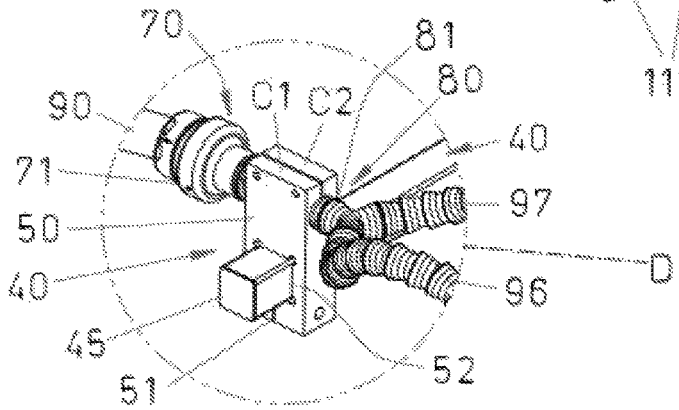
FIG. 5 is a closer view of the hose connector of FIG. 4 fitted on a carrying structure in the present support device.

One example of such hose connectors 50, 60 is shown in detail in FIGS. 4, 5 of the drawings in which support member, connecting member and arms are not shown for clarity. Hose connectors 50, 60 are connector blocks each including an inner cavity (for example a through cavity 52) that is conveniently shaped and sized as the above mentioned cross-sectional configuration of the carrying bar 45 (square shaped in the embodiment shown). The hose connectors 50, 60 can be therefore easily coupled in and decoupled from the carrying bar 45 of the arm structure 20 in the support device 10 and be rapidly exchanged if necessary.

Reference is now made to FIGS. 4, 5 which show the hose connectors 50, 60 in detail. For the sake of clarity, arms 21, 22 are not depicted here. Hose connectors 50, 60 each comprise a block connector as disclosed above that is made of an appropriate vibration damping material such as a suitable plastic material capable of withstanding vibrations during operation specially when the suction machine rapidly changes from minimum pressure values to maximum pressure values, for example of the order of 0 to 250 mb and 250 to 0 mb, repeatedly. This is important for holding the applicators 110 always in a constant height H to the ground (see FIG. 2) in which they are in direct contact with the patient's skin thorough treatment.

Each block connector is formed of a two prismatic pieces C1, C2 that can be seen in FIGS. 4 and 5. At least the outermost one of said prismatic pieces C1, C2 is provided with a lower cut 51 for a better adaptation to the carrying bar 45. As shown in FIGS. 4 and 5, the prismatic pieces C1, C2 are attached to each other through their major surfaces.

Each hose connector 50, 60 is provided with one inlet 70 and one outlet 80. The inlet 70 is provided with a movable joint 71 that is configured to receive at least one pressurized air inlet hose 90 that conducts pressurized air from a suction machine 100 (shown in FIGS. 6 and 7) to the support device 10. The suction machine 100 may be of a known type and with different capacities and features according to the skin treatment to be performed.

The movable joint 71 allows the pressurized air inlet hose 90 not to interfere with the support device 10 when positioned at any desired location. The outlet 80 of the hose connectors 50, 60 may be also provided with a corresponding movable joint 81 configured to receive at least one pressurized air outlet hose 96, 97. The pressurized air outlet hose(s) 96, 97 may be of a semirigid nature and in some embodiments, there may be provided two air outlet hoses 96, 97 coupled to a block connector through a movable T-joint 81. Said outlet hoses 96, 97 lead to respective applicators 110. However, although two air outlet hoses 96, 97 have been provided, a different number of air outlet hoses 96, 97 may be provided. Other number of hose connectors 50, 60 may be of course used too. They can be all coupled to the carrying bar 45 of the arm structure 20.

With this arrangement, several modes of treatment can be used, for example including either the supply of the same pressure values through all the outlet hoses 96, 97 or the supply of different pressure values through said outlet hoses 96, 97 according to the treatment requirements.

In the embodiment shown, applicators 110 are suction cups for skin treatment. As shown in the FIGS. 1-7, the applicators 110 are coupled in the same carrying bar 45 and may differ from each other according to the requirements of the treatment.

The present support device as shown and described is adaptable in position and movable as required for an effective skin treatment in such a way that treatment can be conducted in an automatic and autonomous way without the need for sanitary and/or cosmetic professional personnel. Applicators for such a treatment can be put at any suitable position for patients laying on a stretcher, sitting in a wheelchair or even standing up and in general in situations where the patient has to be muscle/skin treated by a suction machine.

Figure 6:
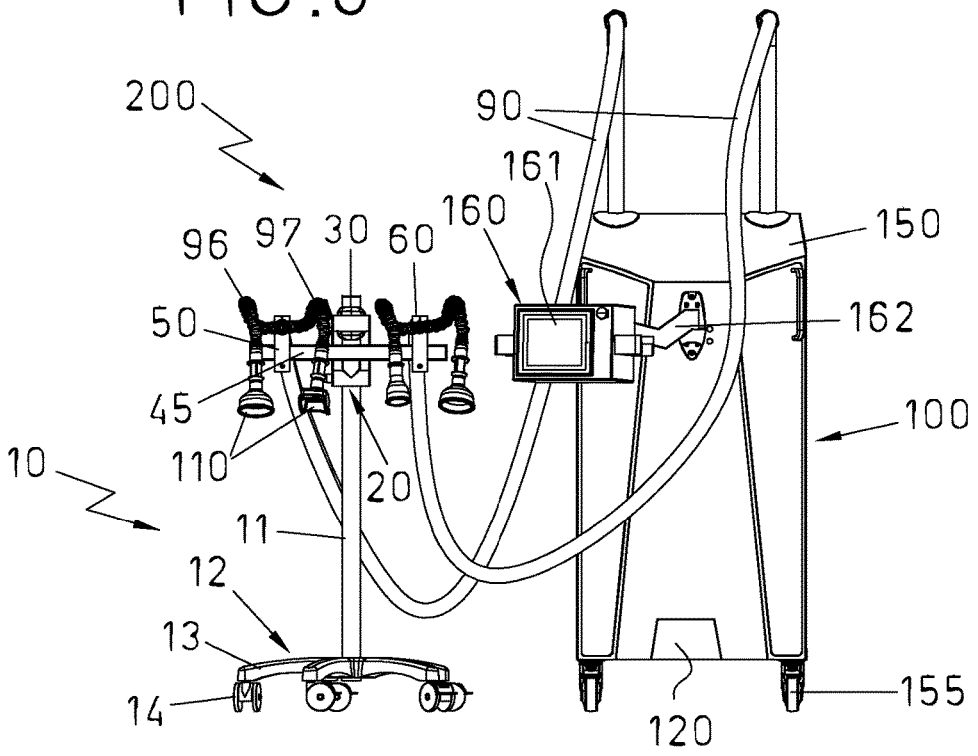
FIG. 6 is a general perspective view of one embodiment of a skin treatment assembly according to the present support device in which a suction machine and the support device of FIGS. 1-3 are also shown.
Figure 7:
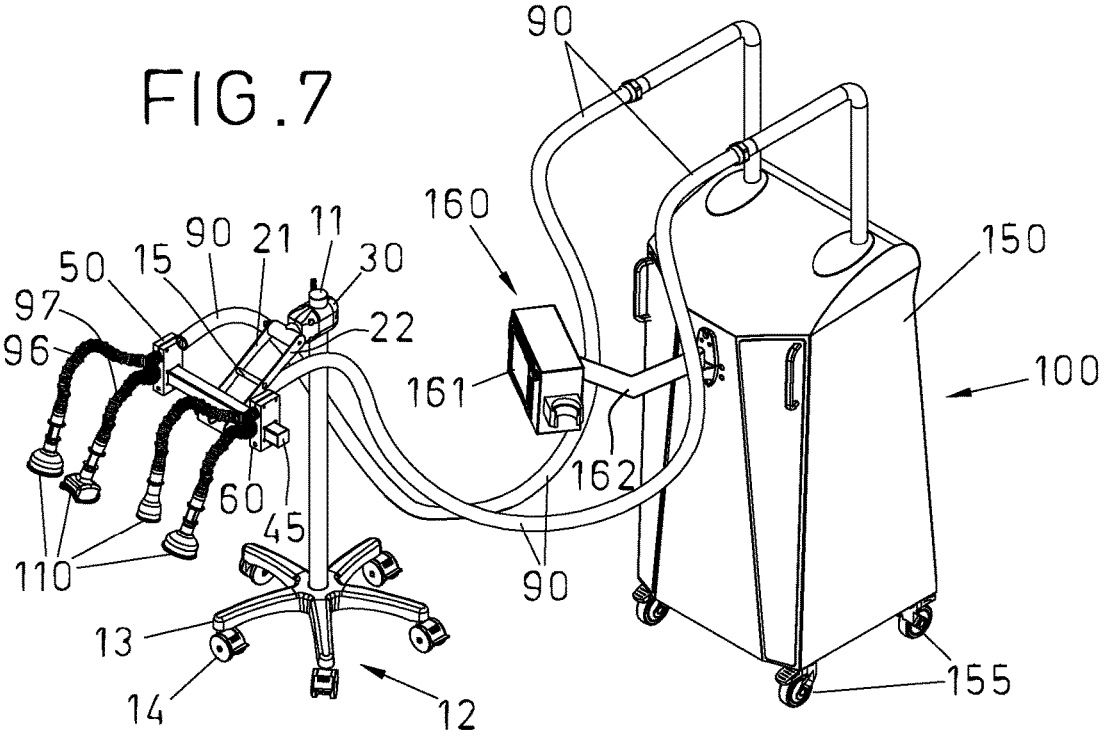
FIG. 7 is a front elevational view of the embodiment of the skin treatment assembly of FIG. 6.

In FIGS. 6 and 7 a skin treatment assembly 200 according to the disclosure is shown. The treatment assembly 200 comprises a suction machine 100 and the above described support device 10.

The suction machine 100 comprises a housing 150 provided with wheels 155 at the base thereof for ease of moving. Controller 160 is also provided for controlling certain treatment parameters such as length, pressure, applicator position, etc. Controller 160 includes an output device comprising a display screen 161 through which the operator is allowed to control treatment. A keyboard can be provided for entering treatment parameters and selecting a mode of treatment. The display screen 161 is fitted at one end of a mount arm 162. The mount arm 162 is attached, at the opposite end thereof, to the suction machine housing 150.

There may be embodiments in which the controller 160 is fitted in the support device 10 instead of the suction machine 100 such that it is nearer to the operator.

Suction device 120 is provided within the housing 150 of the suction machine 100. Suction device 120 may comprise a vacuum pump suitable for applying different pressurized airflow patterns (for example, pressure changing values every 0.1-0.5 s) to a patient through applicators 110.

The invention claimed is:

1. Support device for a skin treatment assembly for maintaining skin treatment machine applicators at a given position when in use, the support device comprising:

a connecting member; a carrying structure having a carrying bar; an arm structure comprising two substantially parallel arms associated with the connecting member; and, at least one hose connector associated with said arm structure and with the skin treatment machine applicators, wherein the at least one hose connector is adapted for receiving outlet hoses of a semi-rigid, self-supporting nature configured so that it is not necessary to hold the machine applicators throughout the skin treatment, the outlet hoses also being configured for conducting pressurized air to the respective skin treatment machine applicators for applying different pressurized airflow patterns;

wherein the semi-rigid, self-supporting nature of the outlet hoses includes the hoses being not fully rigid or are partly rigid to the extent that the outlet hoses are configured to be moved by external intentional manipulation, but, also that the applicators connected to the outlet hoses will not be moved by themselves after they have been arranged in a desired position suitable for and during operation in a treatment; wherein each arm of the arm structure has two opposite ends, one of these two opposite ends is pivotally mounted on the connecting member, and another of which configured to pivotally receive the carrying structure configured to carry said hose connectors such that the arm structure is pivotable around respective horizontal axes at said ends of each arm; wherein the at least one hose connector comprises an inner cavity; and wherein the inner cavity is configured to receive the carrying bar.

2. Support device as claimed in claim 1, wherein the hose connector comprises a connector block.

3. Support device as claimed in claim 1, wherein it further comprises a fastener for fixing the relative position of the arm structure.

4. Support device as claimed in claim 1, wherein the arm structure is pivotable around respective horizontal axes at the respective opposite ends of the parallel arms.

5. Support device as claimed in claim 1, wherein it further comprises at least one motor for driving the arm structure upwards or downwards and/or for driving the pivotal movement of the arm structure.

6. Support device as claimed in claim 1, wherein it further comprises a base portion.

7. Support device as claimed in claim 1, wherein the connecting member and the arm structure comprising two substantially parallel arms associated with the connecting member are configured so that the connecting member is movable such that the arm structure attached to the outlet hoses is adjustable in height.

8. Support device as claimed in claim 1, wherein it further comprises a support member to which the connecting member is displaceably connected.

9. Skin treatment assembly comprising:

a skin treatment machine having a device for applying pressurized air to a patient through skin treatment machine applicators connected to corresponding hoses, and a support device comprising:

a connecting member; a carrying structure having a carrying bar; an arm structure comprising two substantially parallel arms associated with the connecting member, and at least one hose connector associated with said arm structure and with said skin treatment machine applicators, wherein the hose connector is adapted for receiving outlet hoses of a semi-rigid, self-supporting nature configured so that it is not necessary to hold the machine applicators throughout the skin treatment, the outlet hoses also being configured for conducting pressurized air to the skin treatment machine respective applicators for applying different pressurized airflow patterns;

wherein the semi-rigid, self-supporting nature of the outlet hoses includes the hoses being not fully rigid or are partly rigid to the extent that the outlet hoses are configured to be moved by external intentional manipulation, but, also that the applicators connected to the outlet hoses will not be moved by themselves after they have been arranged in a desired position suitable for and during operation in a treatment; wherein each arm of the arm structure has two opposite ends, one of which ends is pivotally mounted on the connecting member, and another of which ends configured to pivotally receive the carrying structure configured to carry said hose connectors such that the arm structure is pivotable around respective horizontal axes at said ends of each arm; wherein the at least one hose connector comprises an inner cavity; and wherein the inner cavity is configured to receive the carrying bar.

10. Skin treatment assembly as claimed in claim 9, wherein the hose connector comprises a connector block.

11. Skin treatment assembly as claimed in claim 9, wherein it further comprises a fastener for fixing the relative position of the arm structure.

12. Skin treatment assembly as claimed in claim 9, wherein the arm structure is pivotable around respective horizontal axes at the respective opposite ends of the parallel arms.

13. Skin treatment assembly as claimed in claim 9, wherein it further comprises at least one motor for driving the arm structure upwards or downwards and/or for driving the pivotal movement of the arm structure.

14. Skin treatment assembly as claimed in claim 9, wherein it further comprises a base portion.

15. Skin treatment assembly as claimed in claim 9, wherein the connecting member and the arm structure comprising two substantially parallel arms associated with the connecting member are configured so that the connecting member is movable such that the arm structure attached to the outlet hoses is adjustable in height.

16. Skin treatment assembly as claimed in claim 9, wherein it further comprises a support member to which the connecting member is displaceably connected.

* * * * *